US007063581B2

(12) United States Patent
Takada et al.

(10) Patent No.: US 7,063,581 B2
(45) Date of Patent: Jun. 20, 2006

(54) OUTBOARD MOTOR OPERATING SYSTEM

(75) Inventors: Hideaki Takada, Wako (JP); Hiroshi Watabe, Wako (JP); Hiroshi Mizuguchi, Wako (JP); Taiichi Otobe, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/116,814

(22) Filed: Apr. 28, 2005

(65) Prior Publication Data

US 2005/0245147 A1 Nov. 3, 2005

(30) Foreign Application Priority Data

Apr. 30, 2004 (JP) ..... 2004-136125

(51) Int. Cl.
*B63H 20/08* (2006.01)

(52) U.S. Cl. ..... 440/61 G

(58) Field of Classification Search ..... 440/1, 440/2, 61 G
See application file for complete search history.

(56) References Cited

U.S. PATENT DOCUMENTS

2003/0224673 A1* 12/2003 Takada et al. ..... 440/84
2004/0072481 A1* 4/2004 Watabe et al. ..... 440/85

FOREIGN PATENT DOCUMENTS

JP 2004-001640 1/2004

* cited by examiner

*Primary Examiner*—Stephen Avila
(74) *Attorney, Agent, or Firm*—Carrier, Blackman & Associates, P.C.; William D. Blackman; Joseph P. Carrier

(57) ABSTRACT

An outboard motor operating system, includes a shared switch for inputting operation instructions to either a steering (hydraulic) cylinder for steering an outboard motor or a PTT unit for regulating the tilt/trim angles of the outboard motor. The system also includes a first group of signal lines connected to the steering cylinder, a second group of signal lines connected to the PTT unit, and a third group of signal lines connected to the shared switch. The operating system also includes a selector switch for connecting either the first or second group of signal lines to the third group of signal lines. Thus, a shared operating system is provided for inputting operation instructions to the steering cylinder and PTT unit, and the destination of the instructions is made selectable, enabling a reduction in the number of components and a reduction in the amount of space needed for installing the operating system on the boat.

13 Claims, 11 Drawing Sheets

OUTBOARD MOTOR OPERATING SYSTEM

CROSS-REFERENCE TO RELATED APPLICATION

This application claims priority under 35 U.S.C. §119 from Japanese Patent Application No. 2004-136125, filed on 30 Apr. 2004, the entire disclosure of which is hereby incorporated by reference.

BACKGROUND OF THE INVENTION

1. Field of the Invention

This invention relates to an outboard motor operating system.

2. Description of the Related Art

In recent years, technologies have been developed for using actuators to steer and regulate the tilt and trim angles of outboard motors, as taught, for example, by Japanese Laid-Open Patent Application No. 2004-1640. This reference teaches a system that operates a steering actuator when a sensor detects rotation of a steering wheel and operates tilt and trim angle regulation actuators when a switch for inputting tilt and trim angle regulation instructions is operated.

This prior art system disadvantageously increases the number of steering system components because the operation instructions for the steering actuator and those for the tilt and trim angle regulation actuators are input through different operating systems installed on the hull (boat). Another problem with the system is that it increases the amount of space needed for installing the operating system on the boat.

SUMMARY OF THE INVENTION

An object of the present invention is therefore to overcome the foregoing drawbacks by providing an operating system for an outboard motor equipped with a steering actuator and tilt and trim angle regulation actuators that enables a reduction in the number of components of the operating system for inputting the operation instructions to the respective actuators and in the amount of space needed for installation on the hull.

In order to achieve the object, in a first embodiment of the present invention, there is provided an operating system for an outboard motor adapted to be mounted on a stern of a boat and having a propeller with a rudder to propel and steer the boat. The operating system includes a steering actuator swiveling the outboard motor relative to the boat to steer; a tilt/trim actuator tilting/trimming the outboard motor to regulate a tilt/trim angle of the outboard motor; and an operation instruction input device to be operable by an operator for inputting an instruction to operate at least one of the steering actuator and the tilt/trim actuator. The operating system also includes a first signal line connected to the steering actuator; a second signal line connected to the tilt/trim actuator; a third signal line connected to the operation instruction input device; and a selector switch connecting one of the first signal line and the second signal line to the third signal line.

BRIEF DESCRIPTION OF THE DRAWINGS

The above and other objects and advantages of the invention will be more apparent from the following description and drawings in which.

DETAILED DESCRIPTION OF ILLUSTRATIVE EMBODIMENTS

Here follows a description of selected illustrative embodiments of an outboard motor operating system according to the invention made with reference to the appended drawings.

Figure 1:
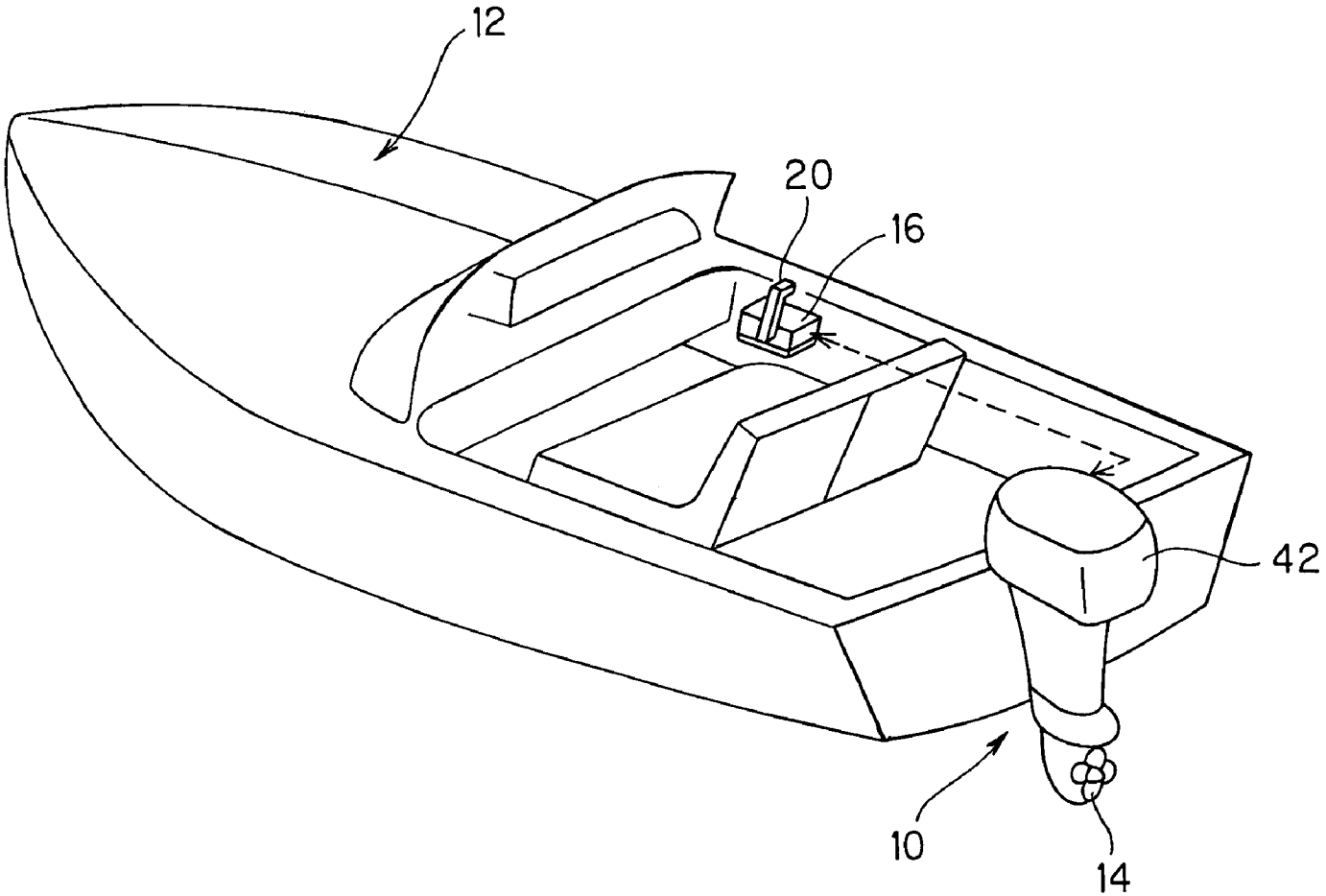
FIG. 1 is an overall schematic view of a boat having an outboard motor operating system according to a first embodiment of the invention installed thereon, with primary focus on the outboard motor.

FIG. 1 is an overall schematic view of an a boat equipped with outboard motor operating system according to a first embodiment of the invention, with primary focus on the outboard motor.

As shown in FIG. 1, an outboard motor 10 is mounted on the stern of a hull (boat) 12. The outboard motor 10 is equipped with an engine 40 (FIG. 5) (not shown) at the top and with a propeller 14 at the bottom. The propeller 14, which operates to propel the boat 12 in the forward and reverse directions, is rotated by power transmitted from the engine 40. A remote control box 16 is mounted near the operator's seat of the boat 12. The remote control box 16 can communicate with the outboard motor 10.

Figure 2:
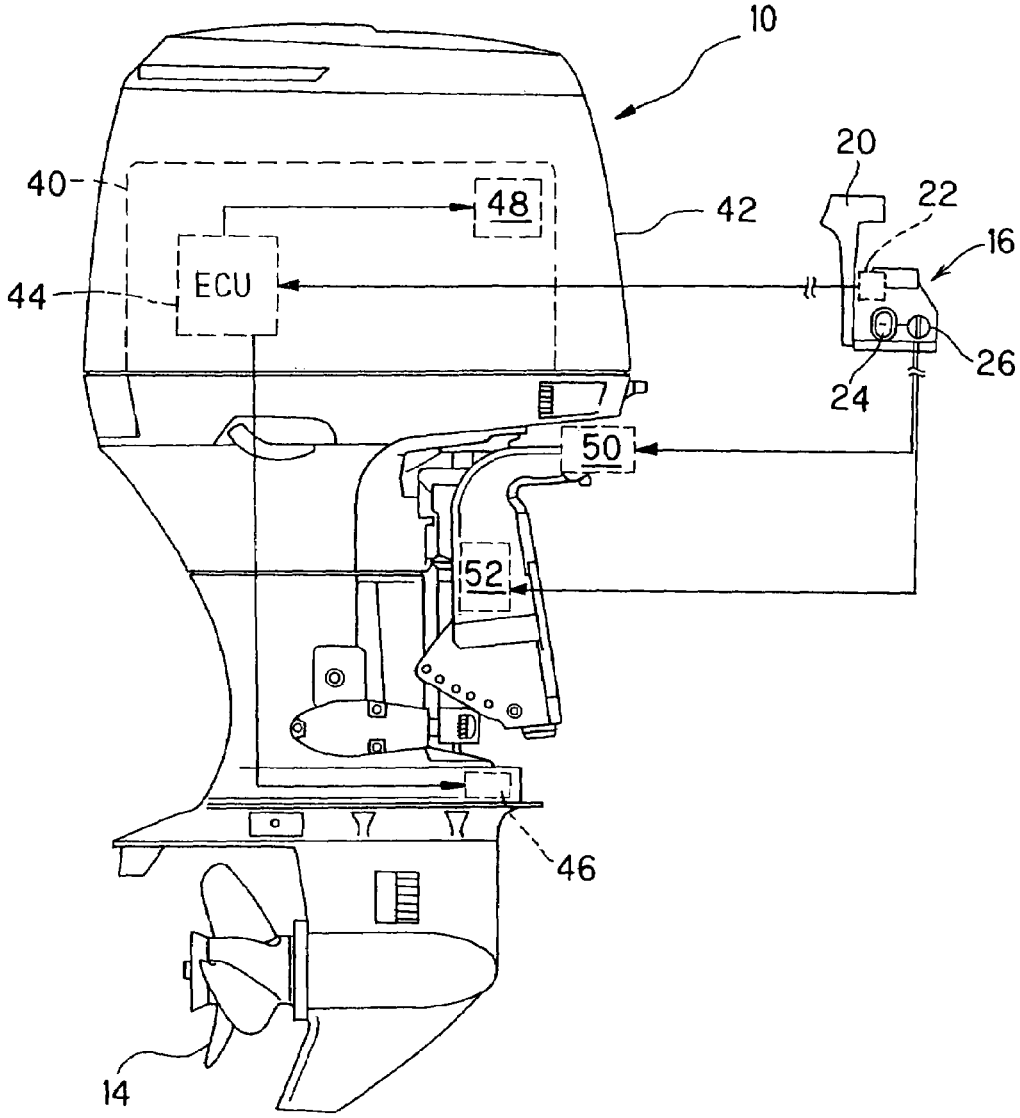
FIG. 2 is an explanatory schematic view showing the interconnection between the outboard motor shown in FIG. 1 and a remote control box.

FIG. 2 is an explanatory schematic view showing the interconnection between the outboard motor 10 and the remote control box 16.

As shown in FIG. 2, a shift-throttle lever 20 (forward/reverse instruction input device) is provided on a lateral or side face of the remote control box 16. A shift-throttle lever position sensor 22 installed near the shift throttle lever 20 outputs a signal corresponding to the position to which the operator sets the shift-throttle lever 20.

A shared switch 24 (operation instruction input device) and a selector switch 26 (signal line selection device) are mounted on the front of the remote control box 16.

Figure 3:
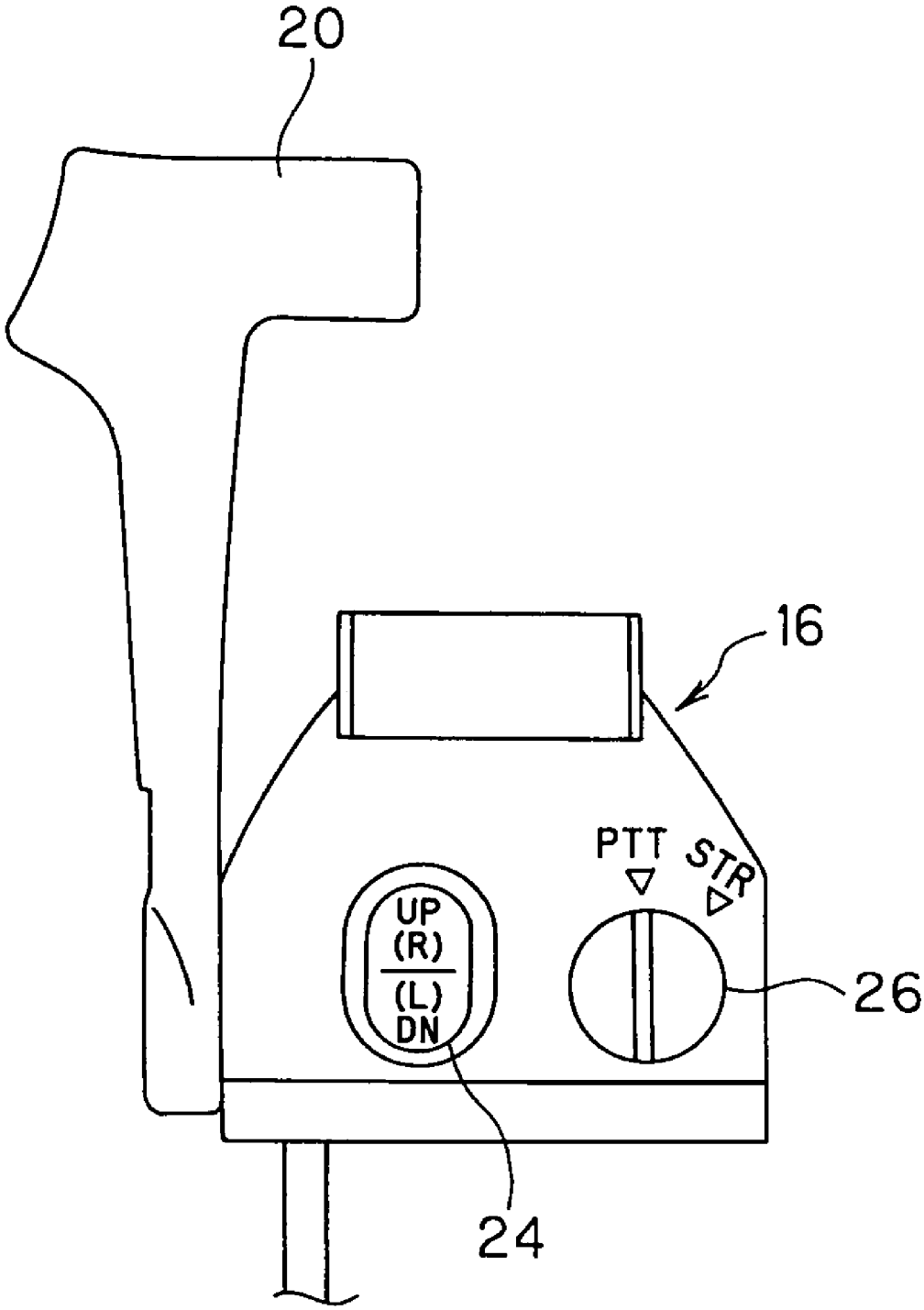
FIG. 3 is an enlarged front view of the remote control box of the system shown in FIG. 1.
Figure 4:
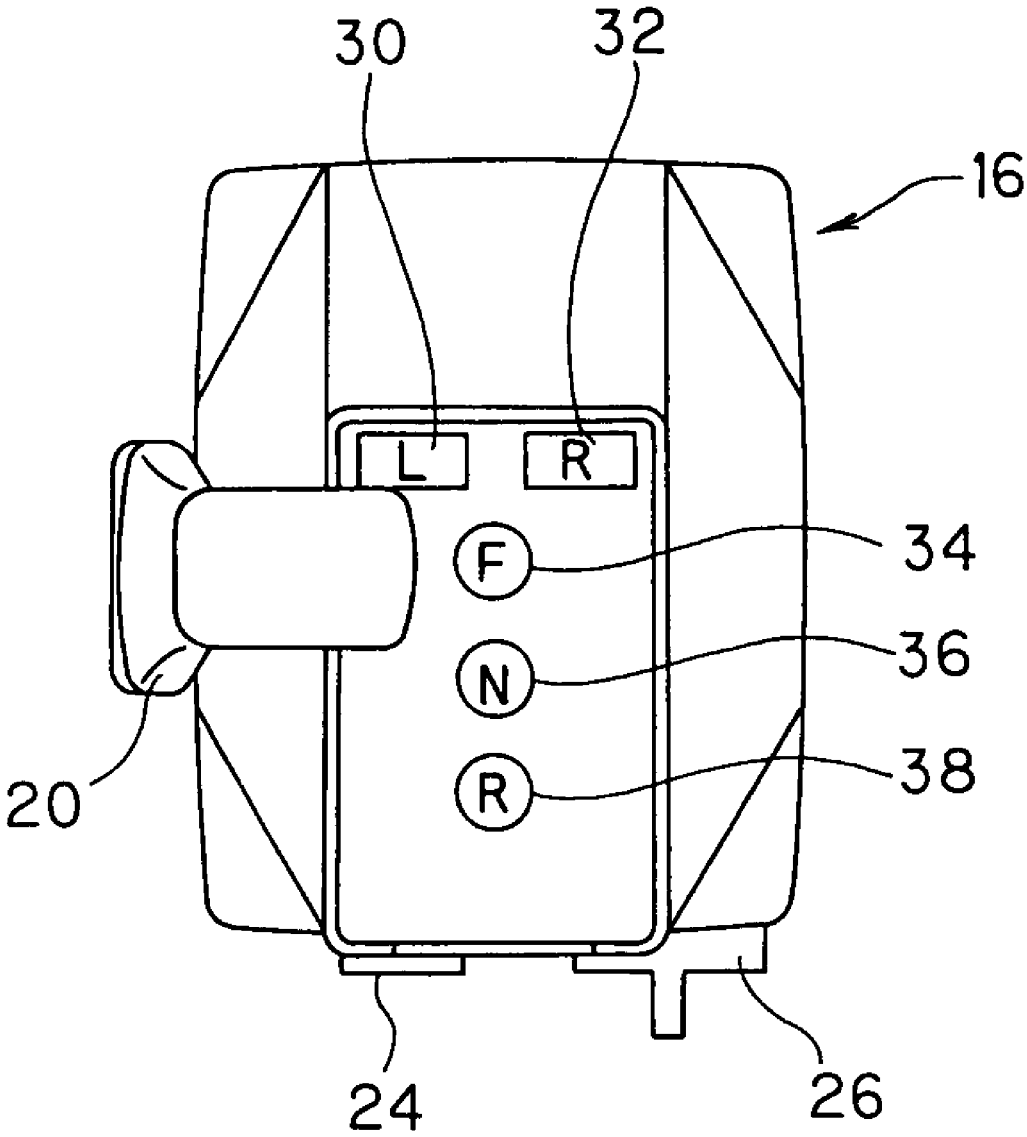
FIG. 4 is an enlarged top plan view of the remote control box of the system shown in FIG. 1.

FIG. 3 is an enlarged front plan view of the remote control box 16. FIG. 4 is an enlarged top plan view of the remote control box 16.

As shown in FIG. 3, the shared switch 24 is a rocker switch that can be toggled between two settings by pressing its upper and lower halves. The selector switch 26 can be manipulated to select between an STR (steering) position and a PTT (power tilt-trim) position.

As shown in FIG. 4, the top of the remote control box 16 is provided with five indicators, namely, left turn indicator 30, right turn indictor 32, FWD (forward) indicator 34, N (neutral) indicator 36 and REV (reverse) indicator 38.

The explanation of FIG. 2 will be resumed. The outboard motor 10 is equipped at the top portion with the engine 40. The engine 40 is an internal combustion engine and may be a spark-ignition, V-type, six-cylinder gasoline engine. The engine 40 is enclosed by an engine cover 42 and positioned above the water surface. An electronic control unit (ECU) 44 including a microcomputer is installed near the engine 40 enclosed by the engine cover 42.

The output of the shift-throttle lever position sensor 22 is sent to the ECU 44. Based on the signal received from the shift-throttle lever position sensor 22, the ECU 44 controls the outboard motor 10 to propel the boat 12 forward or reverse (backward). Specifically, it operates an electric shift motor 46, in accordance with the direction of manipulation of the shift-throttle lever 20, so as to select the direction of the propulsion (forward or reverse) produced by the outboard motor 10. The ECU 44 also operates an electric throttle motor 48, in accordance with the amount of manipulation of the shift-throttle lever 20, so as to regulate the throttle opening (control the speed) of the engine 40. The FWD indicator 34, N indicator 36 and REV indicator 38 light when the shift position is forward, neutral and reverse, respectively.

The output of the shared switch 24 is sent through a selector switch 26 to either a steering hydraulic cylinder (steering actuator) 50 or a PTT (power tilt-trim) unit (tilt-trim angle regulation actuator) 52. The PTT unit 52 is fabricated as a unit integrating three hydraulic cylinders, a hydraulic pump for supplying hydraulic pressure to the cylinders, and an electric motor (not shown in FIG. 2) for operating the hydraulic pump.

When the output of the shared switch 24 is received by the steering hydraulic cylinder 50 (more exactly, by an electric motor that operates a hydraulic pump (neither shown) for supplying hydraulic pressure thereto), the steering hydraulic cylinder 50 operates to swivel the outboard motor 10 so that the boat 12 is steered to turn left or right. When the boat 12 turns left, the left turn indicator 30 lights and when it turns right, the right turn indictor 32 lights.

When the output of the shared switch 24 is received by the PTT unit 52 (more exactly, by an electric motor therein), the PTT unit 52 operates to regulate the tilt and trim angles of the outboard motor 10.

Figure 5:
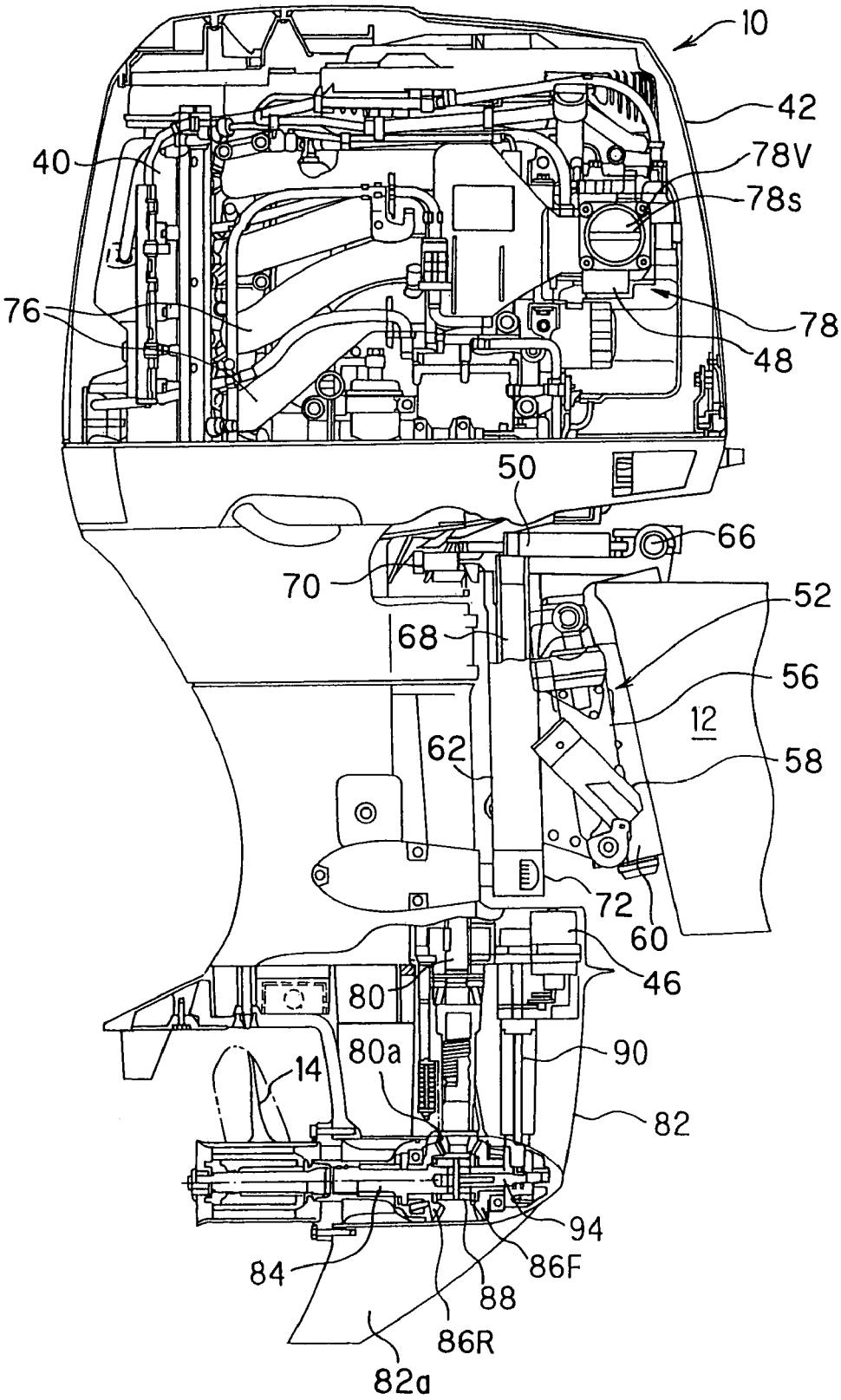
FIG. 5 is a side view, partially in section, of the outboard motor shown in FIGS. 1–2.

FIG. 5 is a side view, partially in section, of the outboard motor 10. The structure of the outboard motor 10 will now be explained with reference to FIG. 5.

As shown in FIG. 5, the PTT unit 52 is equipped with three hydraulic cylinders, namely, one hydraulic cylinder 56 for tilt angle regulation (hereinafter called "tilt hydraulic cylinder 56") and two hydraulic cylinders 58 for trim angle regulation (only one shown; hereinafter called "trim hydraulic cylinders 58").

One end (cylinder bottom) of the hydraulic cylinder 56 is fastened to stern brackets 60 and through it to the boat 12, and the other end (piston rod head) thereof is fastened to a swivel case 62. One end (cylinder bottom) of each hydraulic cylinder 58 is fastened to stern brackets 60 and through it to the boat 12, similarly to the one end of the hydraulic cylinder 56, and the other end (piston rod head) thereof abuts on the swivel case 62.

The swivel case 62 is connected to the stem brackets 60 through a tilting shaft 66. The swivel case 62 houses a rotatable swivel (steering) shaft 68. The upper end of the swivel shaft 68 is fastened to a mount frame 70 and its lower end is fastened to a lower mount center housing 72. The mount frame 70 and lower mount center housing 72 are fastened to a frame (not shown) on which the engine 40 etc. are mounted.

The steering hydraulic cylinder 50 is mounted above the swivel case 62. One end (cylinder bottom) of the steering hydraulic cylinder is attached to the swivel case 62 and the other end (piston rod head) thereof is attached to the mount frame 70. Thus, when the piston rod head of the steering hydraulic cylinder 50 extends or contracts, the mount frame 70 rotates to steer the outboard motor 10 about the horizontal axis.

A throttle body 78 is installed on the upstream side of an intake manifold 76 of the engine 40. The throttle motor 48 is integrally connected with the throttle body 78. The throttle motor 48 and a throttle shaft 78S that supports a throttle valve 78V are interconnected through a gear mechanism (not shown) installed adjacent to the throttle body 78.

The output of the engine 40 is transmitted, via a crankshaft (not shown) and a drive shaft 80, to a propeller shaft 84 housed in a gear case 82, and rotates the propeller 14. The gear case 82 is formed integrally with a rudder 82*a*.

A forward gear 86F and a reverse gear 86R are provided around the propeller shaft 84 to mesh with a drive gear 80*a* and be rotated in opposite directions. A clutch 88 that rotates integrally with the propeller shaft 84 is provided between the forward gear 86F and reverse gear 86R. The clutch 88 is operated by a shift rod 90, which is driven by an electric shift motor 46, and a shift slider 94 to mesh with either the forward gear 86F or the reverse gear 86R, thereby switching the direction of rotation of the propeller 14, i.e., shifting between forward and reverse.

Figure 6:
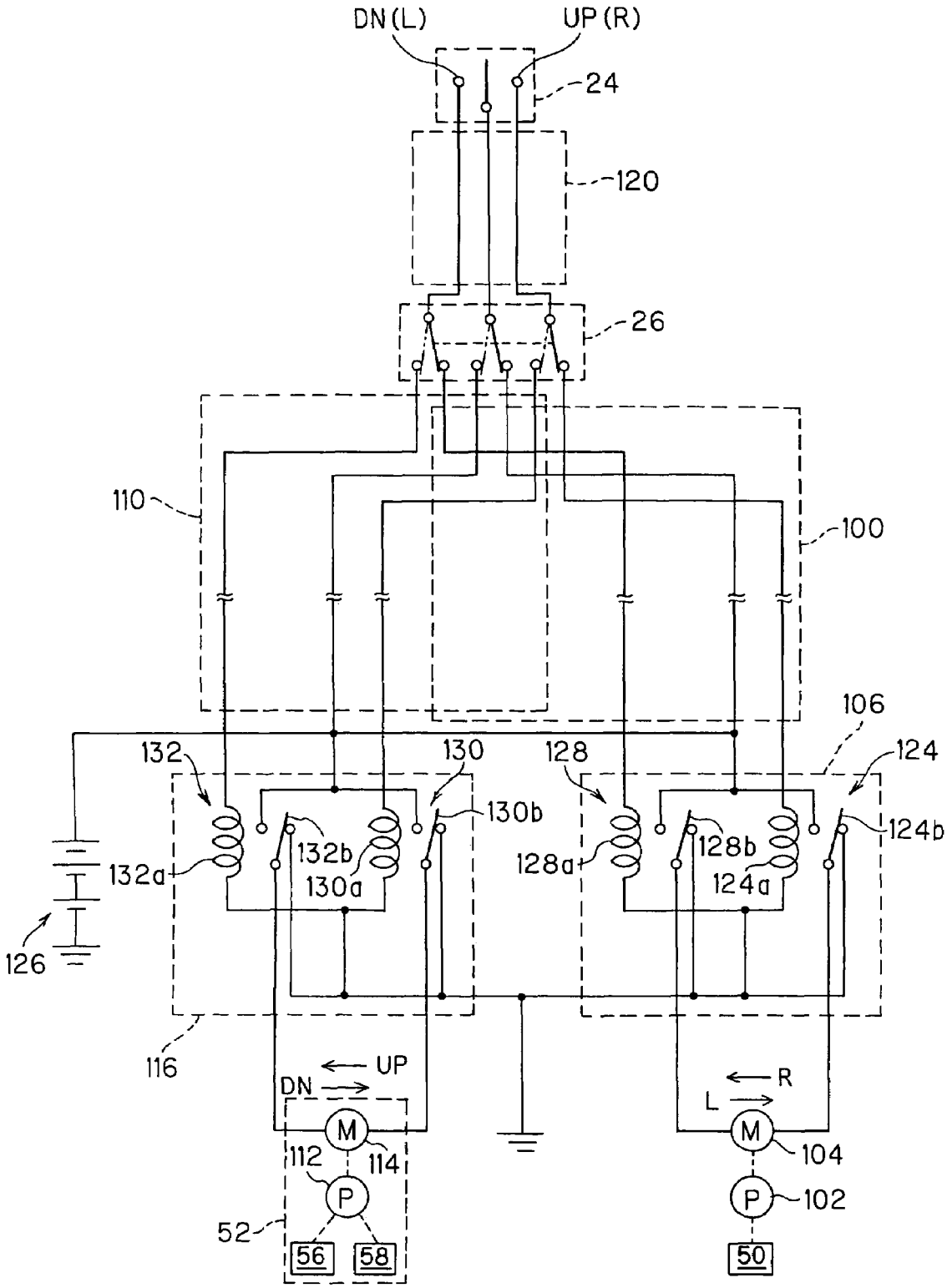
FIG. 6 is an electrical circuit diagram showing a circuit configuration for interconnecting a shared switch shown in FIG. 2 with a steering hydraulic cylinder and a PTT unit.

FIG. 6 is an electrical circuit diagram showing a circuit configuration for interconnecting the shared switch 24 with the steering hydraulic cylinder 50 and the PTT unit 52.

As shown in FIG. 6, the steering hydraulic cylinder 50 is connected to first group of signal lines 100. Specifically, a hydraulic pump 102 is connected to the steering hydraulic cylinder 50 through a hydraulic circuit (not shown) and the hydraulic pump 102 is connected to an electric motor 104 to be operated thereby. The motor 104 is connected to the first group of signal lines 100 through a motor driver 106.

The PTT unit 52 is connected to a second group of signal lines 110. Specifically, the tilt hydraulic cylinder 56 and trim hydraulic cylinders 58 in the PTT unit 52 are connected to a hydraulic pump 112 through hydraulic circuits (not shown) and the hydraulic pump 112 is connected to an electric motor 114 to be operated thereby. The motor 114 is connected to the second group of signal lines 110 through a PTT relay 116.

The shared switch 24 is connected to a third group of signal lines 120. The third group of signal lines 120 are connected through the selector switch 26 to either the first group of signal lines 100 or the second group of signal lines 110.

The operation of the electrical circuit will now be explained.

In the case where the third group of signal lines 120 are connected to the first group of signal lines 100 by the selector switch 26 as illustrated (when the aforesaid STR position has been selected), if the shared switch 24 is manipulated to close the contact marked UP(R) in the drawing (if the upper half of the shared switch 24 shown in FIG. 3 is pressed), a coil 124*a* of a first relay 124 (a contact relay) provided in the motor driver 106 is energized to close a movable contact 124*b*, thereby supplying electric current to the motor 104 from a battery 126 installed at an appropriate location in the outboard motor 10.

As a result, the hydraulic pump 102 is operated to supply hydraulic pressure to the steering hydraulic cylinder 50 and steer the outboard motor 10. When the contact on the UP(R) side of the shared switch 24 is closed, the steering hydraulic cylinder 50 is operated in the direction for turning the outboard motor 10 counterclockwise so that the boat 12 turns right. At this time, the right turn indictor 32 is lit via an electric circuit not shown in the drawings.

In the case where the third group of signal lines 120 are connected to the first group of signal lines 100 by the selector switch 26 as illustrated, if the shared switch 24 is manipulated to close the contact marked DN(L) in the drawing (if the lower half of the shared switch 24 shown in FIG. 3 is pressed), a coil 128*a* of a second relay 128 (a contact relay) provided in the motor driver 106 is energized to close a movable contact 128*b*, thereby supplying electric current to the motor 104 in the opposite direction from when contact on the UP(R) side is closed.

As a result, the hydraulic pump 102 and the steering hydraulic cylinder 50 are operated in the opposite direction from when the contact on the UP(R) side is closed, so that the outboard motor 10 is turned clockwise and the boat 12 turns left. At this time, the left turn indictor 30 is lit via an electric circuit not shown in the drawings.

On the other hand, in the case where the third group of signal lines 120 are connected to the second group of signal lines 110 by the selector switch 26 as indicated by phantom lines in FIG. 6 (when the aforesaid PTT position has been selected), if the shared switch 24 is manipulated to close the contact on the UP(R) side, a coil 130*a* of a third relay 130 (a contact relay) provided in the PTT relay 116 is energized to close a movable contact 130*b*, thereby supplying electric current to the motor 114.

As a result, the hydraulic pump 112 is operated to supply hydraulic pressure to the tilt hydraulic cylinder 56 and trim hydraulic cylinders 58 and regulate the tilt and trim angles of the outboard motor 10. When the contact on the UP(R) side of the shared switch 24 is closed, the hydraulic cylinders 56 and 58 are operated in the direction of increasing the tilt and trim angles. Specifically, after the piston rod heads of the trim hydraulic cylinders 58 have extended, the piston rod head of the tilt hydraulic cylinder 56 is extended.

In the case where the third group of signal lines 120 are connected to the second group of signal lines 110 by the selector switch 26, if the shared switch 24 is manipulated to close the contact on the DN(L) side, a coil 132*a* of a fourth relay 132 (a contact relay) provided in the PTT relay 116 is energized to close a movable contact 132*b*, thereby supplying electric current to the motor 114 in the opposite direction from when the contact on the UP(R) side is closed. As a result, the hydraulic pump 112 is operated to drive the tilt hydraulic cylinder 56 and trim hydraulic cylinders 58 in the opposite direction from that mentioned above, thereby reducing the tilt and trim angles.

Thus, the outboard motor operating system according to the first embodiment of the invention is equipped with the shared switch 24 for inputting operation instructions to either the steering hydraulic cylinder 50 for steering the outboard motor 10 or the PTT unit 52 for regulating the tilt and trim angles of the outboard motor 10, the first group of signal lines 100 connected to the steering hydraulic cylinder 50, the second group of signal lines 110 connected to the PTT unit 52, the third group of signal lines 120 connected to the shared switch 24, and the selector switch 26 for connecting either the first group of signal lines 100 or the second group of signal lines 110 to the third group of signal lines 120.

In other words, a shared operating system is provided for inputting operation instructions to the steering hydraulic cylinder 50 and PTT unit 52, and the destination of the output operation instructions is made selectable. This arrangement makes it possible to reduce the number of components of the operating system and also reduce the amount of space needed for installing the operating system on the boat.

In addition, a remote control box 16 is provided that is equipped with the shift-throttle lever 20 for inputting instructions to make the boat 12 travel forward or backward, and the shared switch 24 and selector switch 26 are also installed on the remote control box 16, thereby reducing the number of components of the operating system and its installation space on the boat. Moreover, the consolidation of the operating system simplifies the work of installing the system on the boat 12.

Figure 7:
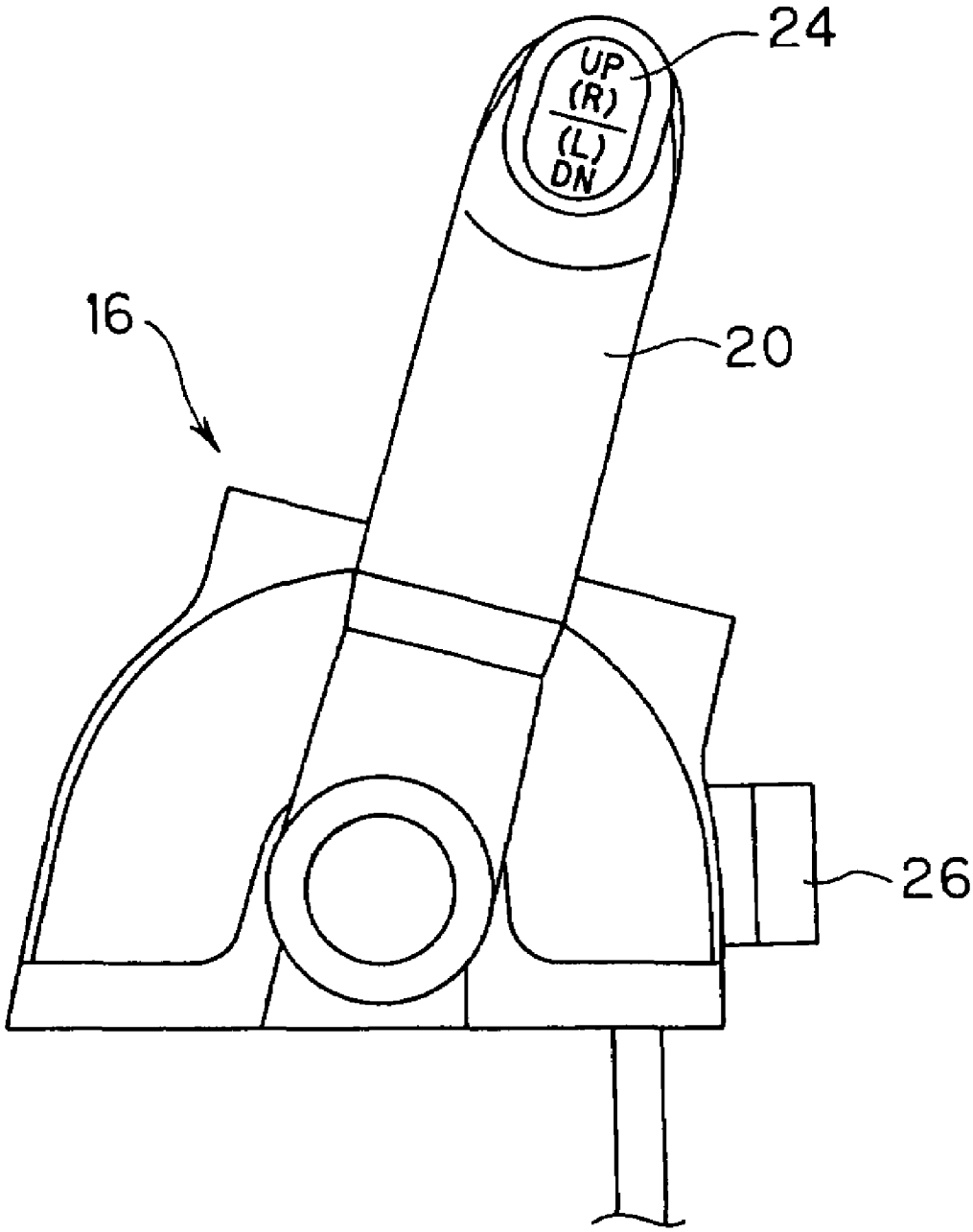
FIG. 7 is an enlarged side plan view of the remote control box showing another example of the installation site of the shared switch shown in FIG. 2.

Although the shared switch 24 is installed on the remote control box 16 in the foregoing embodiment, improved operability can be achieved by instead installing it on the shift-throttle lever 20 as shown in FIG. 7.

Figure 8:
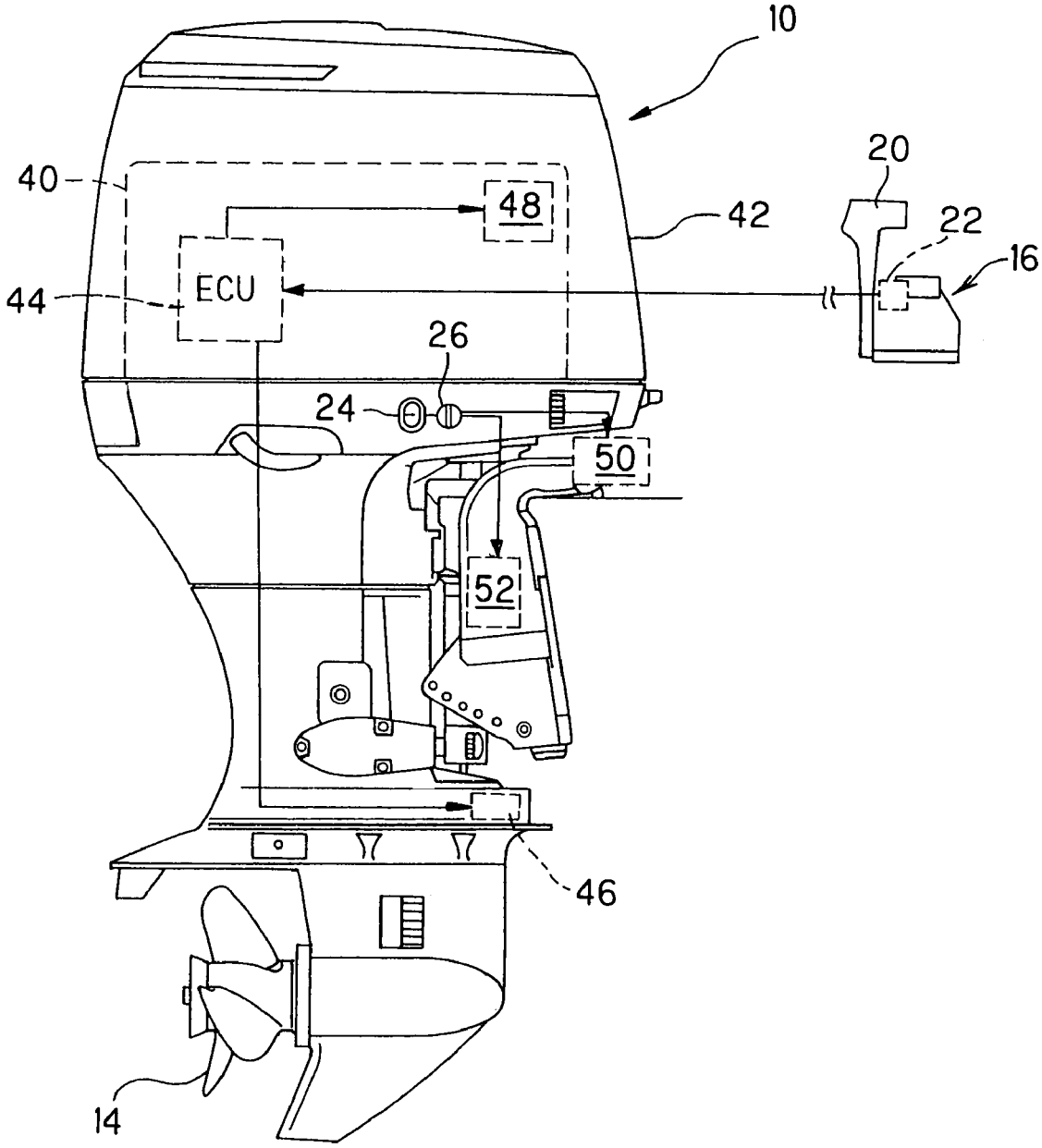
FIG. 8 is an explanatory schematic view showing another example of the installation sites of the shared switch and selector switch.

When the outboard motor 10 is steered using a tiller handle or the like (not shown) provided on the outboard motor, the shared switch 24 and selector switch 26 can, as shown in FIG. 8, be mounted on the outboard motor 10. Installation of the shared switch 24 and selector switch 26 on the outboard motor 10 makes it unnecessary to reserve installation space on the boat 12 and also eliminates the work of installing these switches on the boat.

Alternatively, it is possible to configure the shared switch 24 as a lever like the shift-throttle lever 20, detect the amount and direction of tilting thereof with a sensor, and output an operation signal corresponding to the detection value through the selector switch 26 to the steering hydraulic cylinder 50 or PTT unit 52.

An outboard motor operating system according to a second embodiment of the invention will now be explained.

Figure 9:
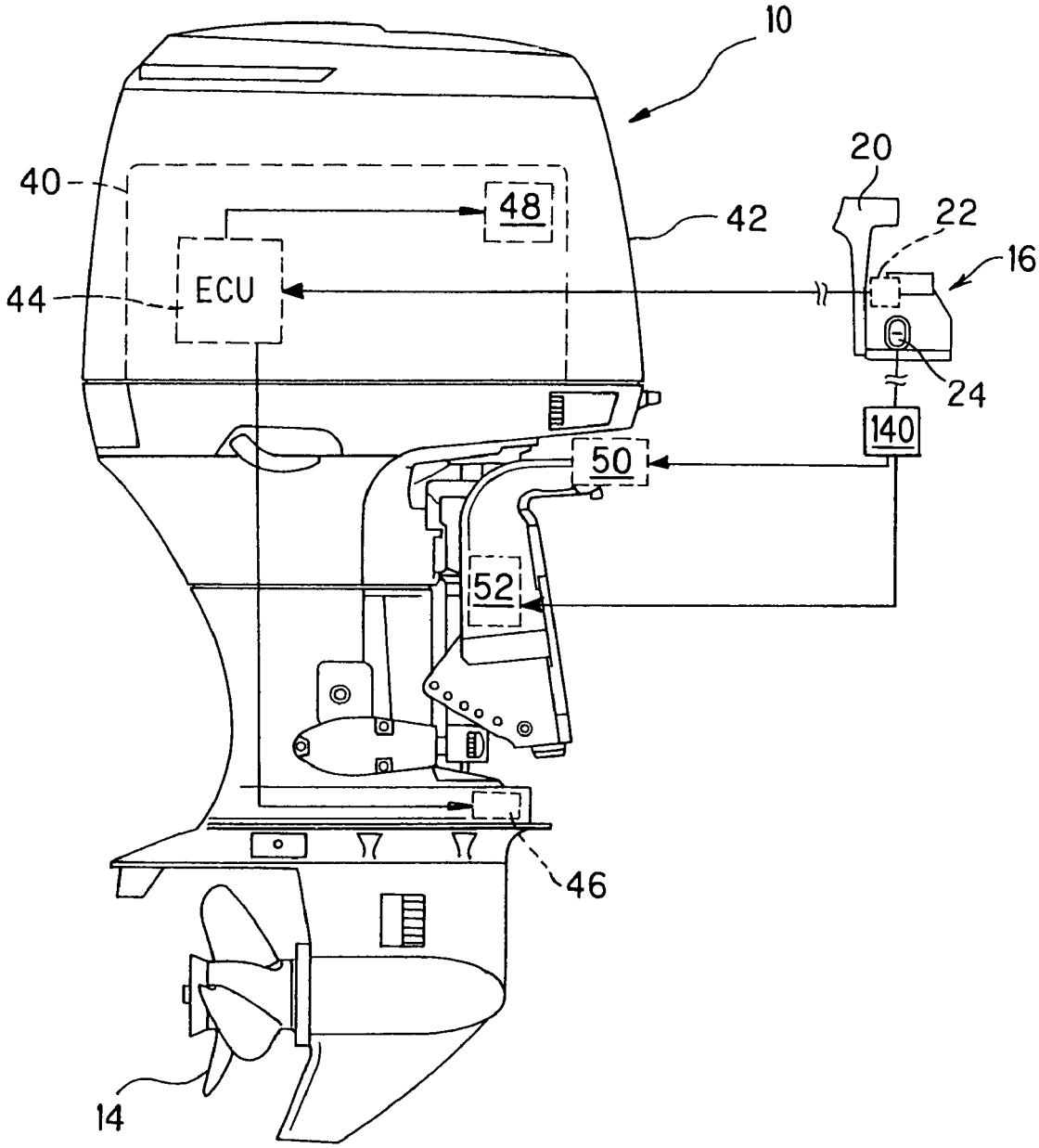
FIG. 9 is an explanatory schematic view, similar to FIG. 2, but showing an outboard motor operating system according to a second embodiment of the invention.

FIG. 9 is an explanatory view, similar to FIG. 2, but showing an outboard motor operating system according to a second embodiment of the invention.

The explanation will be made focusing on the points of difference from the first embodiment. As shown in FIG. 9, in the second embodiment a coupler box 140 is provided instead of the selector switch 26 and the output of the shared switch 24 is forwarded to the steering hydraulic cylinder 50 and PTT unit 52 through multiple couplers accommodated in the coupler box 140.

Figure 10:
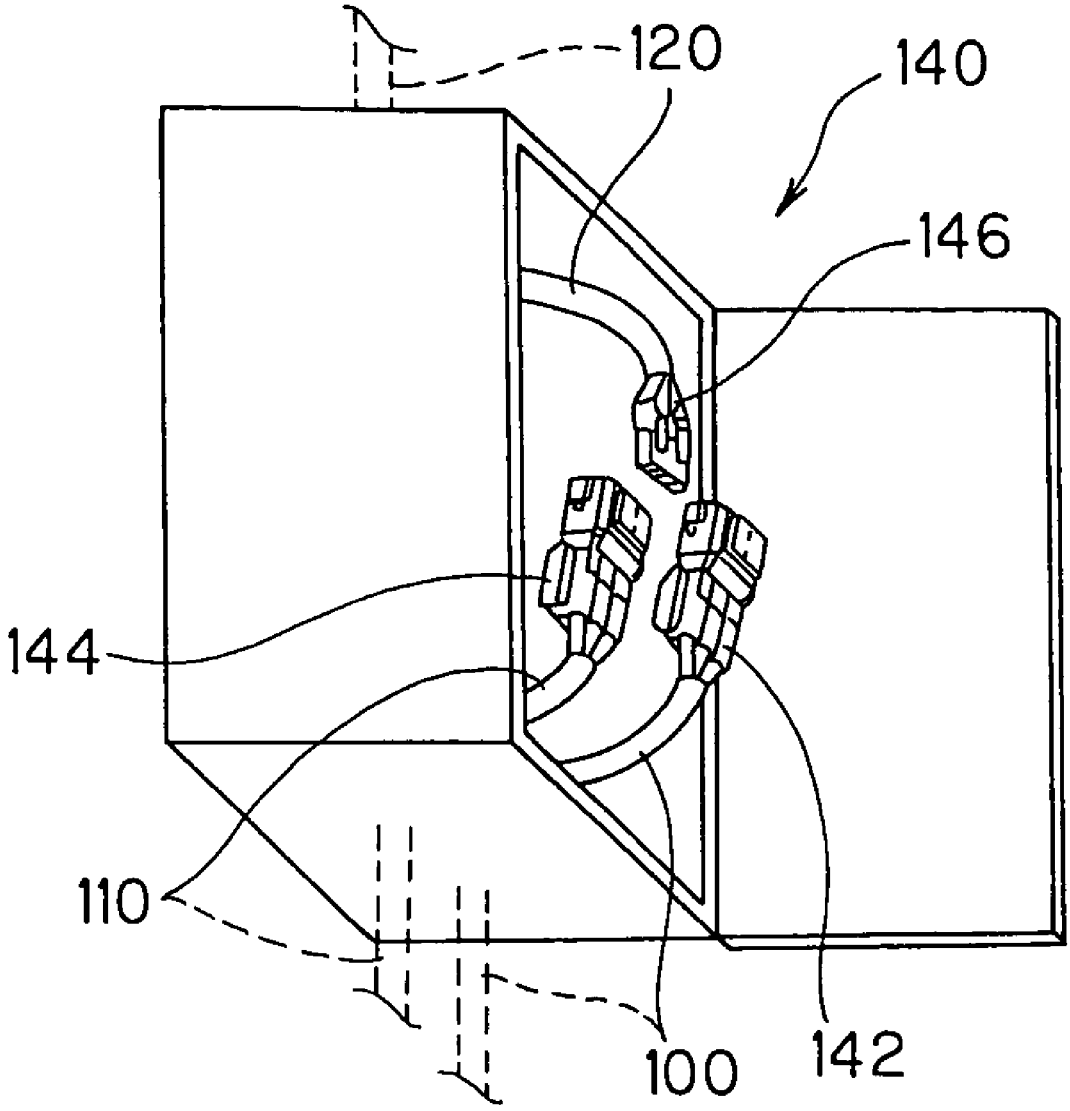
FIG. 10 is an enlarged perspective view of a coupler box shown in FIG. 9.

FIG. 10 is an enlarged perspective view of the coupler box 140. As illustrated in FIG. 10, a first coupler 142 is provided at the end of the first group of signal lines 100. A second coupler 144 shaped identical to the first coupler 142 is provided on the second group of signal lines 110. A third coupler 146 manually connectable (engageable) with the first and second couplers 142 and 144 is provided on the third group of signal lines 120. The first to third couplers 142, 144 and 146 are accommodated in the coupler box 140. The coupler box 140 is constituted as a water-tight case.

Figure 11:
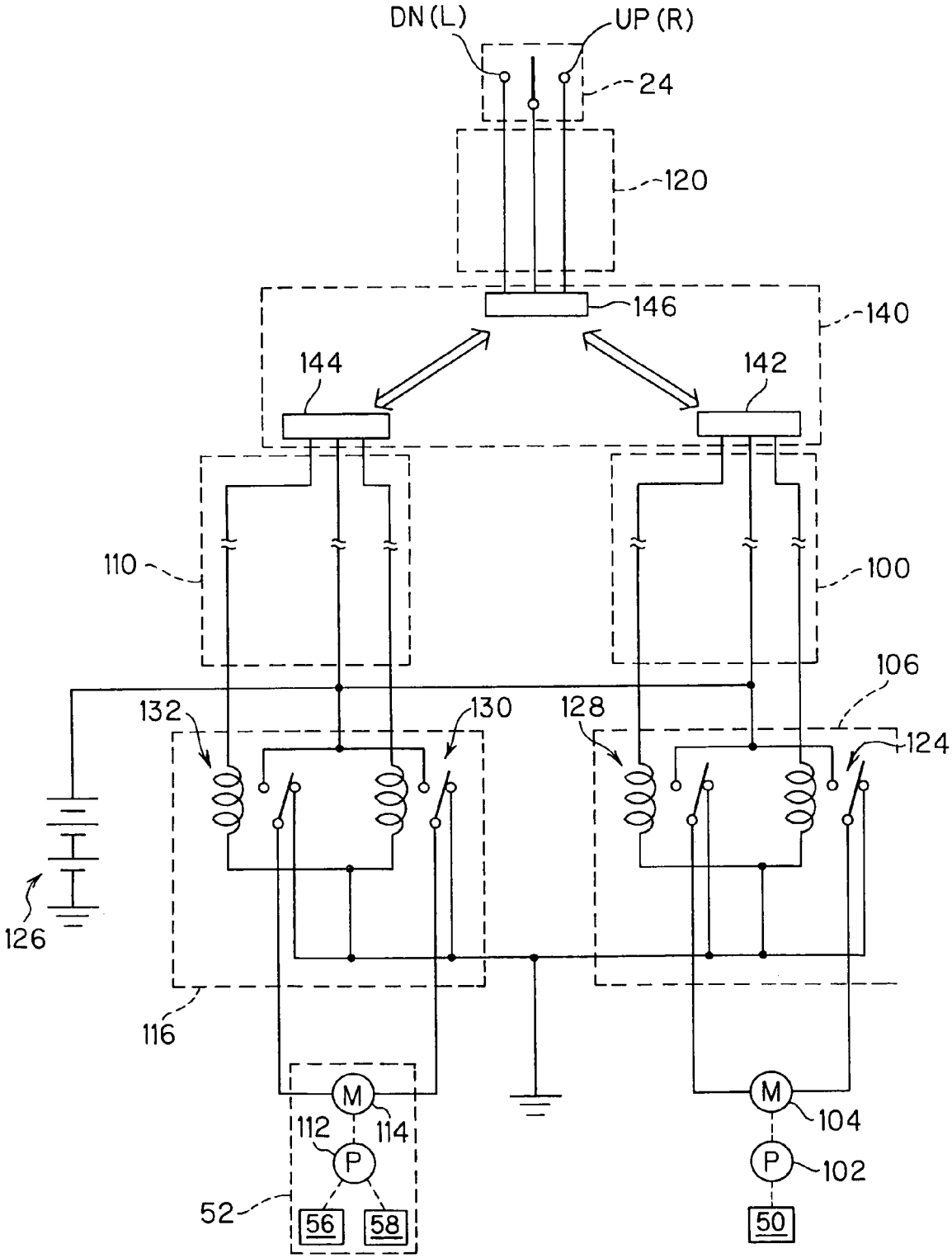
FIG. 11 is an electrical circuit diagram similar to FIG. 6 showing a circuit configuration for interconnecting a shared switch with a steering hydraulic cylinder and a PTT unit.

FIG. 11 is an electrical circuit diagram similar to FIG. 6 showing a circuit configuration for interconnecting the shared switch 24 with the steering hydraulic cylinder 50 and the PTT unit 52.

As shown in FIG. 11, one or the other of the first group of signal lines 100 and the second group of signal lines 110 can be connected to the third group of signal lines 120 by manually connecting the associated first coupler 142 or second coupler 144 with the third coupler 146. Thus, the steering hydraulic cylinder 50 and PTT unit 52 can be operated or driven similarly to in the first embodiment by manipulating the shared switch 24 with one or the other of the first coupler 142 and the second coupler 144 put in connection with the third coupler 146.

Thus, the outboard motor operating system according to the second embodiment is equipped with the first coupler 142 provided on the first group of signal lines 100, the second coupler 144 provided on the second group of signal lines 110 and the third coupler 146 provided on the third group of signal lines 120 so as to enable either the first coupler 142 or the second coupler 144 to be manually connected to the third coupler 146. The configuration is therefore simpler than that of the first embodiment.

Moreover, the first to third couplers are accommodated in the coupler box 140 constituted as a water-tight case. This structure, despite its simplicity, enhances the reliability of the system by protecting the signal lines against water.

The remaining structural aspects of the second embodiment are the same as those of the first embodiment and will not be explained again. As in the first embodiment, the installation site of the shared switch 24 is not limited to the top of the remote control box 16 as shown in FIG. 9.

The first to second embodiments are thus configured to have an operating system of an outboard motor 10 mounted on a stern of a boat 12 and having a propeller 14 with a rudder to propel and steer the boat, comprising: a steering actuator (steering hydraulic cylinder 50) for swiveling the outboard motor relative to the boat to steer; a tilt/trim actuator (PTT unit 52) for tilting/trimming the outboard motor to regulate a tilt/trim angle of the outboard motor; an operation instruction input device (shared switch 24) to be operable by an operator for inputting an instruction to operate at least one of the steering actuator and the tilt/trim actuator; a first sigual line (first group of signal lines 100) connected to the steering actuator; a second signal line (second group of signal lines 110) connected to the tilt/trim actuator; a third signal line (third group of signal lines 120) connected to the operation instruction input device; and a selector switch 26 connecting one of the first signal line and the second signal line to the third signal line.

The operating system further includes: a forward/reverse instruction input device (shift-throttle lever 20) to be operable by an operator for inputting an instruction to make the boat travel forward or reverse; and a remote control box 16 mounted at a location near a seat of the operator of the boat; and the forward/reverse instruction input device, the operation instruction input device and the selector switch are installed on the remote control box.

In the operating system, the operation instruction input device (shared switch 24) is installed on the outboard motor 10.

In the operating system, the selector switch 26 comprises: a first coupler 142 provided on the first signal line, a second coupler 144 provided on the second signal line; and a third coupler 146 provided on the third signal line, such that one of the first coupler and the second coupler is to be manually connected to the third coupler, and the first to third couplers are accommodated in a coupler box 140 constituted as a water-tight case.

In the operating system, the remote control box 16 is provided with an indicator, more specifically, the indicator is at least one from among those indicating a direction of steer (left turn indicator 30, right turn indicator 32) and a position of shift (FWD (forward) indicator 34, N (neutral) indicator 36 and REV (reverse) indicator 38).

While the invention has thus been shown and described with reference to specific embodiments, it should be noted that the invention is in no way limited to the details of the described arrangements; changes and modifications may be made without departing from the scope of the appended claims.

What is claimed is:

1. An operating system for an outboard motor adapted to be mounted on a stern of a boat and having an internal combustion engine and a propeller with a rudder to propel and steer the boat, said operating system comprising:
- a steering actuator for swiveling the outboard motor relative to the boat to steer;
- a tilt/trim actuator for tilting or trimming the outboard motor to regulate a tilt/trim angle of the outboard motor;
- an operation instruction input device to be operable by an operator for inputting an instruction to operate at least one of the steering actuator and the tilt/trim actuator;
- a first signal line connected to the steering actuator;
- a second signal line connected to the tilt/trim actuator;
- a third signal line connected to the operation instruction input device; and
- a selector switch connecting one of the first signal line and the second signal line to the third signal line.

2. The operating system according to claim 1, further including:
- a forward/reverse instruction input device to be operable by an operator for inputting an instruction to make the boat travel forward or reverse; and
- a remote control box adapted to be mounted at a location near a seat of the operator of the boat;
- and wherein the forward/reverse instruction input device, the operation instruction input device and the selector switch are installed on the remote control box.

3. The operating system according to claim 1, wherein the operation instruction input device is installed on the outboard motor.

4. The operating system according to claim 1, wherein the selector switch comprises:
- a first coupler provided on the first signal line;
- a second coupler provided on the second signal line; and
- a third coupler provided on the third signal line, such that one of the first coupler and the second coupler is to be manually connected to the third coupler.

5. The operating system according to claim 4, wherein the first to third couplers are accommodated in a water-tight case.

6. The operating system according to claim 2, wherein the selector switch comprises:
- a first coupler provided on the first signal line;
- a second coupler provided on the second signal line; and
- a third coupler provided on the third signal line, such that one of the first coupler and the second coupler is to be manually connected to the third coupler.

7. The operating system according to claim 6, wherein the first to third couplers are accommodated in a water-tight case.

8. The operating system according to claim 3, wherein the selector switch comprises:

a first coupler provided on the first signal line;

a second coupler provided on the second signal line; and a third coupler provided on the third signal line, such that one of the first coupler and the second coupler is to be manually connected to the third coupler.

9. The operating system according to claim 8, wherein the first to third couplers are accommodated in a water-tight case.

10. The operating system according to claim 2, wherein the remote control box is provided with an indicator.

11. The operating system according to claim 10, wherein the indicator is at least one from among those indicating a direction of steer and a position of shift.

12. An operating system for an outboard motor adapted to be mounted on a stem of a boat, the outboard motor having an internal combustion engine and a propeller with a rudder to propel and steer the boat, said operating system comprising:

a steering actuator for swiveling the outboard motor relative to the boat to steer;

a tilt/trim actuator for tilting or trimming the outboard motor to regulate a tilt/trim angle of the outboard motor;

an operation instruction input device to be operable by an operator for inputting an instruction to operate at least one of the steering actuator and the tilt/trim actuator;

a first signal line connected to the steering actuator;

a second signal line connected to the tilt/trim actuator;

a third signal line connected to the operation instruction input device; and a signal line selector switch connecting one of the first signal line and the second signal line to the third signal line so as to permit selective switching between a first connection state in which the first signal line is connected to the third signal line, and a second connection state in which the second signal line is connected to the third signal line.

13. The operating system according to claim 1, further including:

a forward/reverse instruction input device to be operable by an operator for inputting an instruction to make the boat travel forward or reverse; and a remote control box adapted to be mounted at a location near a seat of the operator of the boat;

and wherein the forward/reverse instruction input device, the operation instruction input device and the selector switch are installed on the remote control box.

* * * * *